US007600358B2

(12) United States Patent
Natterer

(10) Patent No.: US 7,600,358 B2
(45) Date of Patent: Oct. 13, 2009

(54) METHOD AND PACKAGING MACHINE FOR PACKAGING A PRODUCT ARRANGED IN A TRAY

(75) Inventor: Johann Natterer, Legau (DE)

(73) Assignee: MULTIVAC Sepp Haggenmuller GmbH & Co. KG (DE)

( * ) Notice: Subject to any disclaimer, the term of this patent is extended or adjusted under 35 U.S.C. 154(b) by 0 days.

(21) Appl. No.: 10/524,154

(22) PCT Filed: Jul. 28, 2003

(86) PCT No.: PCT/EP03/08309

§ 371 (c)(1),
(2), (4) Date: Feb. 11, 2005

(87) PCT Pub. No.: WO2004/022431

PCT Pub. Date: Mar. 18, 2004

(65) Prior Publication Data

US 2005/0257501 A1 Nov. 24, 2005

(30) Foreign Application Priority Data

Aug. 14, 2002 (DE) ..... 102 37 933

(51) Int. Cl.
*B65B 31/02* (2006.01)
*B65D 77/12* (2006.01)

(52) U.S. Cl. ..... 53/432; 53/433; 53/510; 426/396

(58) Field of Classification Search ..... 53/432, 53/433, 453, 510, 511, 559; 426/392, 396
See application file for complete search history.

(56) References Cited

U.S. PATENT DOCUMENTS

| | | | | |
|---|---|---|---|---|
| 4,085,565 | A * | 4/1978 | Mahaffy et al. | 53/511 |
| 4,223,513 | A * | 9/1980 | Mahaffy et al. | 53/432 |
| 4,424,659 | A | 1/1984 | Perigo et al. | |
| 4,685,274 | A * | 8/1987 | Garwood | 53/433 |
| 4,796,408 | A * | 1/1989 | Mobark | 53/427 |

(Continued)

FOREIGN PATENT DOCUMENTS

| | | |
|---|---|---|
| EP | 0 314 546 | 5/1989 |

(Continued)

OTHER PUBLICATIONS

Translation of PCT International Preliminary Examination Report dated Dec. 9, 2004; for PCT/EP2003/008309; International Filing Date Jul. 28, 2003.

*Primary Examiner*—Paul R Durand
(74) *Attorney, Agent, or Firm*—McDonnell Boehnen Hulbert & Berghoff LLP

(57) ABSTRACT

A method for packaging a product arranged in a tray is provided. An upper film located in a distance above the product is clamped along an edge surrounding the tray and is deformed in a direction extending away from the product. Subsequently, evacuating of the space surrounding the product is performed, then a raising of the tray towards the upper film and finally a sealing of the film and of the edge of the tray. In this way, the seam of the upper film and the edge of the tray is attained to be free from creases such that a long-living and good looking package is produced. Additionally, a packaging machine for performing the method is provided.

3 Claims, 12 Drawing Sheets

U.S. PATENT DOCUMENTS

| | | | | | |
|---|---|---|---|---|---|
| 5,155,974 | A | * | 10/1992 | Garwood | 53/510 |
| 5,247,746 | A | * | 9/1993 | Johnson et al. | 53/432 |
| 5,514,392 | A | | 5/1996 | Garwood | |
| 5,529,178 | A | | 6/1996 | Gorlich | |
| 5,534,282 | A | | 7/1996 | Garwood | |
| 5,560,182 | A | * | 10/1996 | Garwood | 53/432 |
| 5,689,937 | A | * | 11/1997 | Gorlich et al. | 53/433 |
| 5,718,101 | A | * | 2/1998 | Noel et al. | 53/432 |
| 5,779,050 | A | * | 7/1998 | Kocher et al. | 206/497 |
| 5,943,844 | A | * | 8/1999 | Wilhelm et al. | 53/442 |
| 6,202,388 | B1 | * | 3/2001 | Sanfilippo et al. | 53/432 |
| 6,282,866 | B1 | | 9/2001 | Natterer et al. | |
| 6,351,928 | B2 | * | 3/2002 | Torre | 53/556 |
| 6,408,598 | B1 | * | 6/2002 | Stockley, III | 53/433 |
| 6,748,726 | B2 | * | 6/2004 | Rossi et al. | 53/510 |
| 7,269,932 | B2 | * | 9/2007 | Konishi | 53/329.5 |

FOREIGN PATENT DOCUMENTS

| | | |
|---|---|---|
| EP | 314546 | 5/1989 |
| EP | 0 489 797 B1 | 1/1996 |
| EP | 1 038 773 | 9/2000 |
| FR | 2 725 692 | 4/1996 |
| IT | 1 244 845 | 11/1990 |
| JP | 56-131117 | 10/1981 |
| JP | 2000-511501 | 12/1998 |

* cited by examiner

METHOD AND PACKAGING MACHINE FOR PACKAGING A PRODUCT ARRANGED IN A TRAY

FIELD OF THE INVENTION

The invention relates to a method for packaging a product arranged in a tray as well as to a packaging machine for conducting such a method.

BACKGROUND AND SUMMARY OF THE INVENTION

For commercialization, many objects and products are packaged in prefabricated trays and sealed with a so-called stretch film. In these cases, a stretchable and in most cases transparent film is wrapped around the tray to fasten the content and to protect it from external influences. Since no hermetical closing-in of the content results, the atmospheric oxygen can adversely affect perishable products. However, the packages are optically very attractive, particularly if food such as meat products protrudes above the edge of the tray and appear very vivid in combination with the transparent cover.

In vacuum packages or so-called atmos-packages, the acting of atmospheric oxygen on perishable food is prevented by hermetical sealing. To achieve this, an impermeable film is sealed onto the tray as a cover after drawing off the air from it by evacuating and possibly substituting it by an inert gas.

If conventional tray sealing machines are used, the content of the package must not protrude above the upper edge of the tray when using a planar covering film, since else the covering film may form creases and during sealing untight spots arise in the sealing seam.

From U.S. Pat. No. 6,408,598 a method for manufacturing such a package is known. A proposal is made to deform a covering film which was heated in a heated cavity above the product. In doing so, the risk is given that creases arise in the peripheral region causing leakages in the sealing region. Additionally, the heating of the covering film before and during deformation is disadvantageous since shrinkable films loose their shrinking property at higher temperatures.

From EP-A-1 038 773 a packaging machine comprising a schematically indicated closing station and an apparatus for feeding trays to be closed by an upper film into the closing station and conveying them out, respectively, is known. In particular, in the known packaging machines such closing stations are implemented to be evacuating and sealing stations.

It is object of the present invention to avoid the above disadvantages in a method for packaging and in a packaging machine, respectively, and to provide a method and a device which allows reliable manufacturing of a package comprising a tray and a product protruding above the edge of the tray. The such-formed product packages shall be impermeable as well as allow for an advantageous presentation under optical aspects.

This object is solved by the method specified in claim 1 and by the packaging machine specified in the two parallel claims 3 and 5.

Further developments of the invention are specified in the subordinate claims, respectively.

BRIEF DESCRIPTION OF THE DRAWINGS

Further features and advantages of the invention will arise from the description of a preferred embodiment with reference to the enclosed figures. The figures show.

DETAILED DESCRIPTION OF EMBODIMENTS OF THE INVENTION

Figure 1:
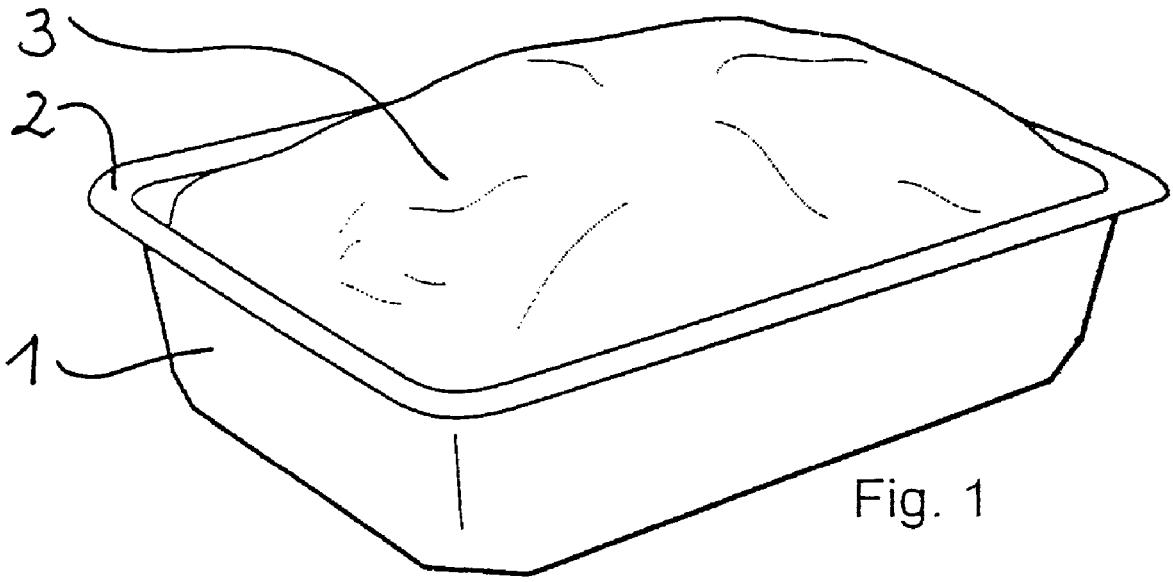
FIG. 1 the example of a package with a protruding product.
Figure 2:
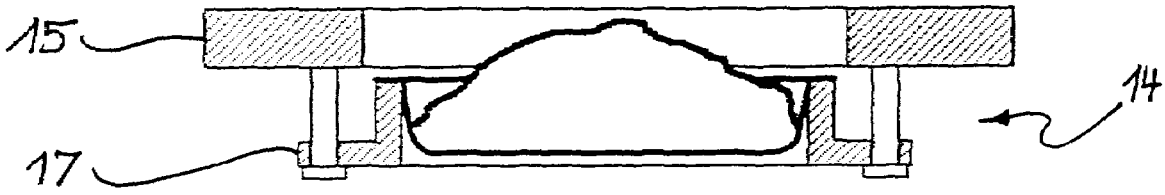
FIG. 2 a cross-section of a tray carrier with inserted tray and protruding product.

FIG. 1 shows an example of a package comprising the actual tray 1 and the product 3 protruding above the edge 2 of the tray.

Figure 3:
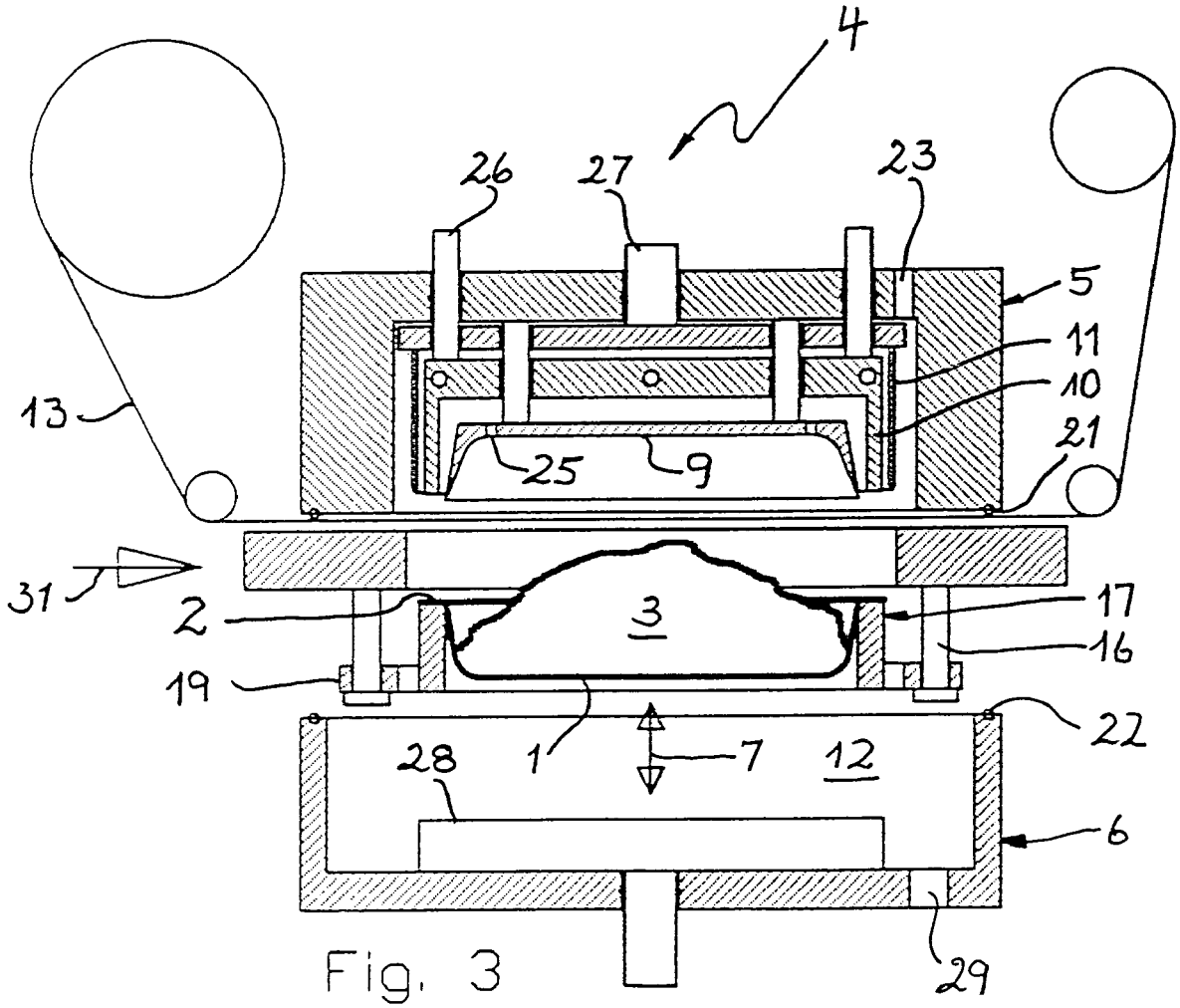
FIG. 3 the tray carrier shown in FIG. 2 in an opened evacuating and sealing station.
Figure 4:
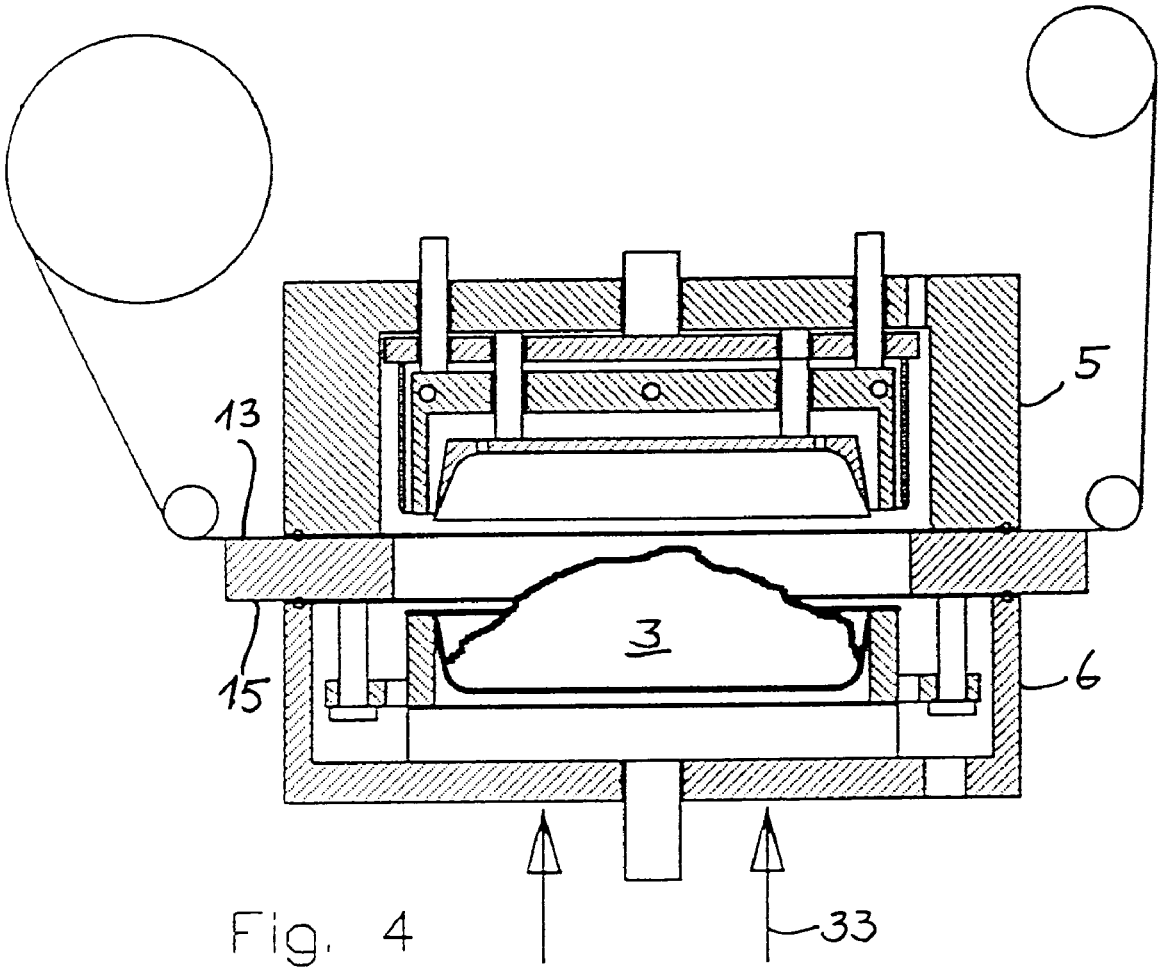
FIG. 4 the evacuating and sealing station shown in FIG. 3 in a closed condition.
Figure 8:
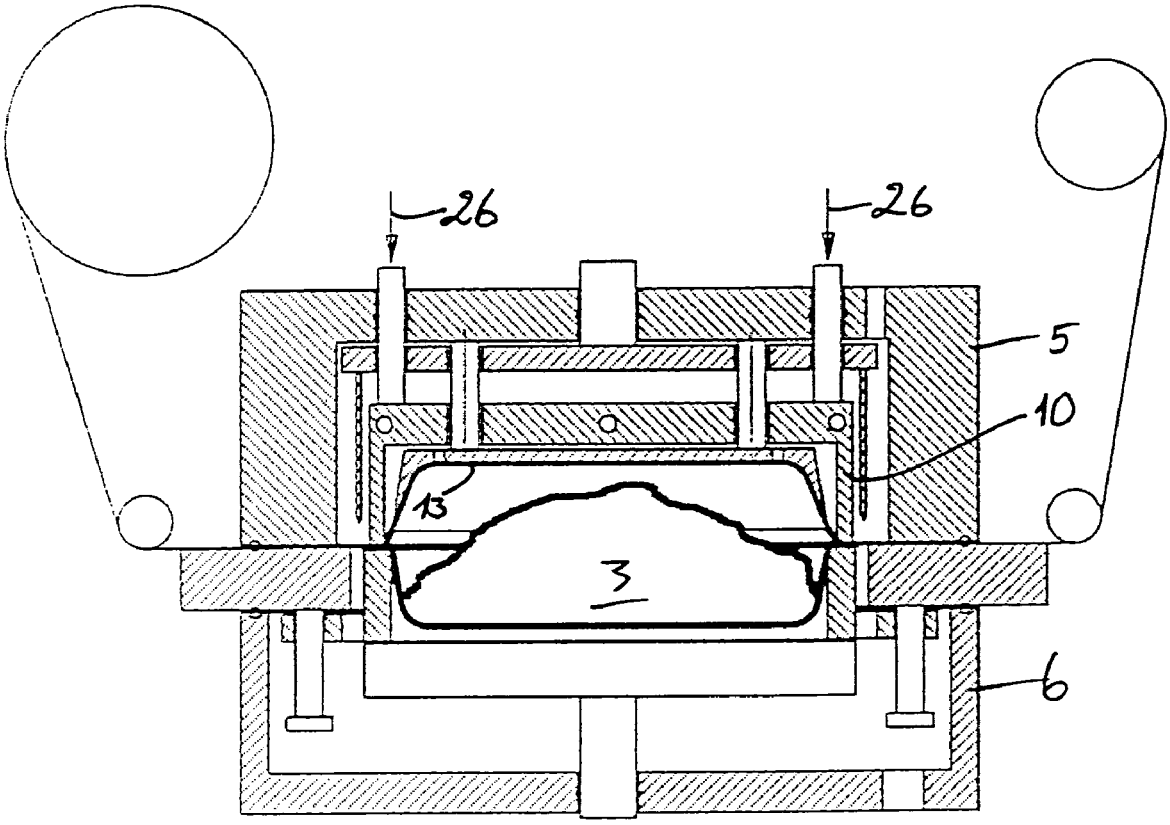
FIG. 8 the evacuating and sealing station in the state of sealing.
Figure 9:
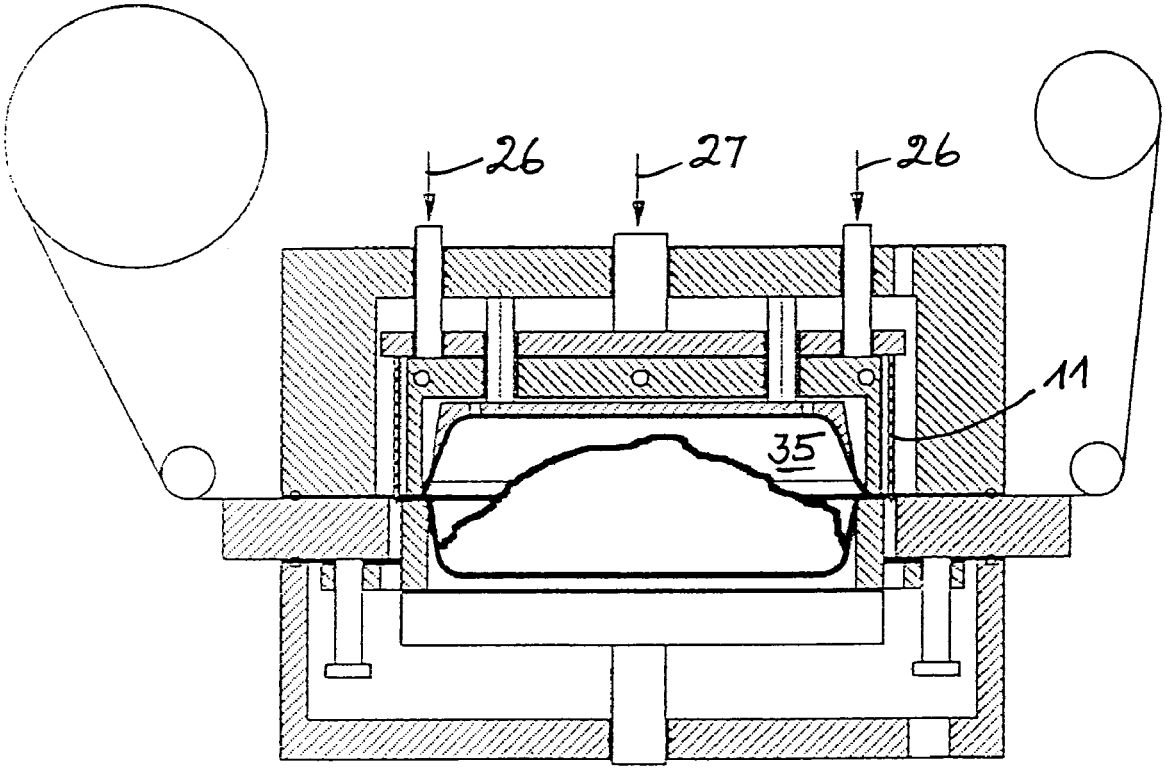
FIG. 9 the evacuating and sealing station with the cutting tool operated.

FIG. 3 shows a sectional view of an evacuating and sealing device 4 consisting of an upper tool 5 and a lower tool 6. The upper tool 5 is fixedly mounted on a frame in this embodiment. The lower tool 6 can be moved in the direction of the arrow 7 down into the lowered position as shown in FIG. 3 and up into the closed position as shown in FIG. 4, respectively, by an elbow lever device or a pneumatic device. The upper tool 5 comprises an internal space 8 which is opened towards the lower tool and in which a forming device 9 with a concave opening facing the lower tool is fixedly mounted. In a manner virtually reaching around this forming device, a conventional sealing tool 10 is provided which is movable from the retracted position shown in FIG. 3 into the sealing position as shown in FIG. 8 by a pneumatic drive mechanism. At last, a cutting device 11 comprising a cutting blade which is surrounding the sealing device and which is also pneumatically movable from the retracted position as shown in FIG. 3 to the cutting position as shown in FIG. 9 and back is provided.

The lower tool comprises an internal space 12 facing the upper tool. An upper film 13 is guided in the plane defined by the lower edge of the upper tool 5.

Furthermore, a device which in the following is referred to as tray carrier 14 is provided for accommodating a tray 1 filled with the product 3 and is initially located outside of the evacuating and sealing device 4. The tray carrier is insertable into the position shown in FIG. 3 in-between the upper tool part 5 and the lower tool part 6 of the evacuating and sealing device by means of a transport device as for example described in the cited EP-A 1 038 773.

The tray carrier 14 has a frame 15 basically arranged in a height corresponding to the lower edge of the upper tool 5, i.e. the upper plane of the frame 15 is directly below the plane of the upper film 13. On its lower surface, the frame 15 has two bolts 16 arranged with a distance in between and serving as a guiding for the actual carrying part 17 of the tray carrier 14. On both outer sides, the carrying part 17 comprises friction bearings 19 running on the bolts 16. Furthermore, on the carrying part 17 a rim is provided which is determined by the shape and the size of the edge 2 of the tray 1 to be accommodated and which accommodates the edge of the tray 1 on its upper edge facing the sealing tool 10. The shape and the size of the facing edge 20 of the sealing tool correspond to the shape and the size of the rim of the carrying part 17.

The upper part has a circumferential gasket 21 peripherally on its edge facing the lower tool, and the lower tool 6 has a gasket 22 on its side facing the upper tool.

Figure 5:
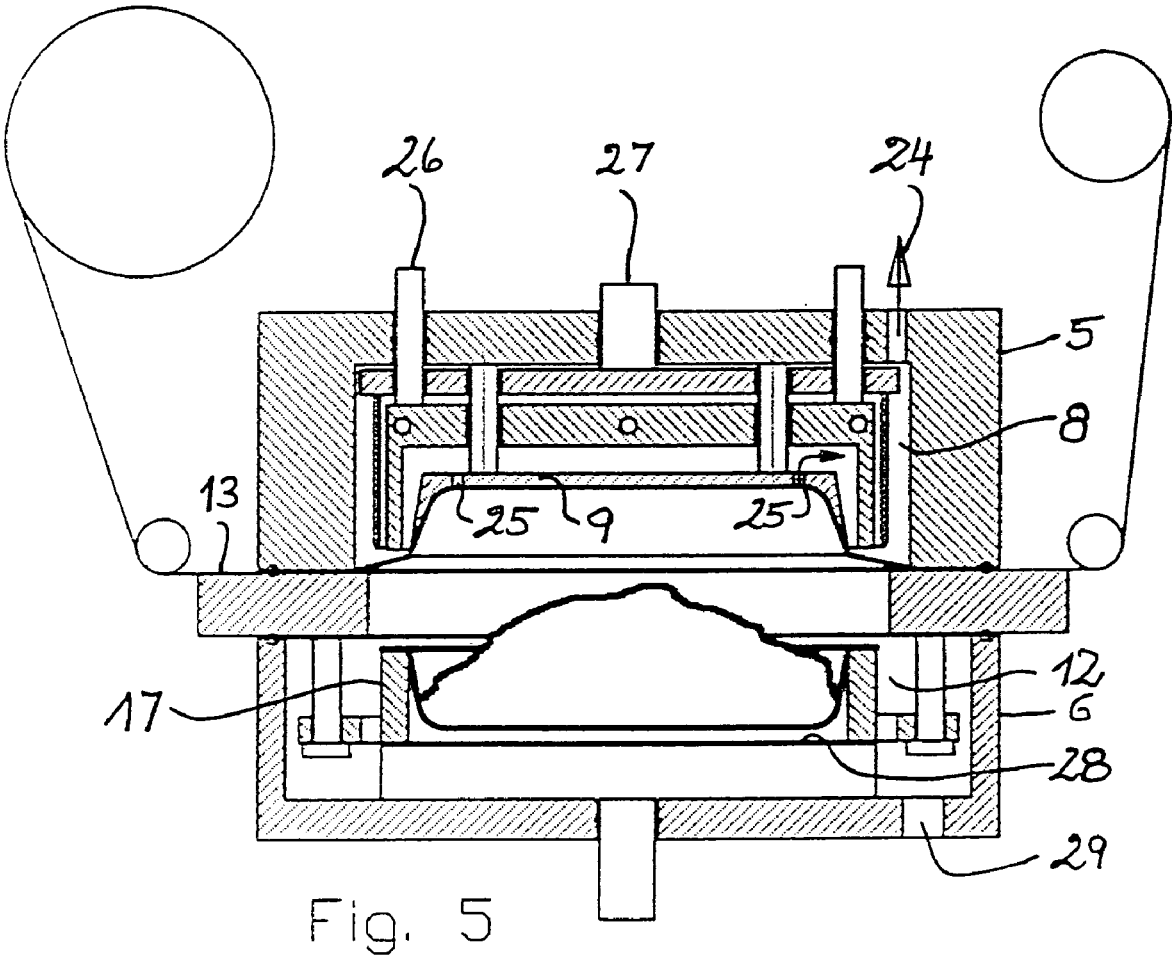
FIG. 5 the closed evacuating and sealing station with applied vacuum and with the tray still lowered.

As can best be seen in FIG. 5, the internal space 8 of the upper tool is connected to a schematically illustrated evacuating device 24 via a bore 23. The forming device 9 has circumferentially located bores 25 in its base plane facing away from the lower tool for connecting the side facing the lower part to the internal space 8 such that, when vacuum is applied via the bore 23, a suction effect is also applied to the side of the bore 25 which faces the lower tool.

Furthermore, pneumatic drive mechanisms 26 for moving the sealing tool up and down and a pneumatic drive mechanism 27 for moving the cutting tool up and down are provided.

First, the internal space 12 of the lower tool 6 has an abutment 28 for supporting the carrying part 17. The internal space 12 is connected to an evacuating and gas supplying device schematically depicted in FIG. 7A via a bore 29.

As can best be seen in comparison of FIGS. 3 and 4, though the frame 15 is fixed in the height as shown in FIG. 3 relative to the height of the upper tool it nevertheless gives way insofar as that it is pressed against the upper tool by the lower tool, when an adequate pressure is applied to the lower tool 6, such that the interior of the evacuating and sealing device is hermetically closed with respect to the exterior.

In operation, the evacuating and sealing device 4 is opened in the position shown in FIG. 3. While in this position, the tray carrier 14 carrying the tray 1 loaded with the product 3 is conveyed into the shown centred position between the tool parts in the direction of the arrow 31. In the next step, the drive mechanism 33 of the lower tool 6 which is schematically indicated in FIG. 4 is operated in such a manner that the lower tool is moved into the closed position as shown in FIG. 4, namely such that the upper film 13 and the frame 15 are clamped in-between the upper tool 5 and the lower tool 6. In this way, the planar, even upper film 13 is circumferentially clamped without creases. In the next step shown in FIG. 5, an evacuating is performed above the upper film by the evacuating device 24 having the consequence of the upper film being sucked to the inner wall of the forming device 9 and thus being stretched.

Figure 6:
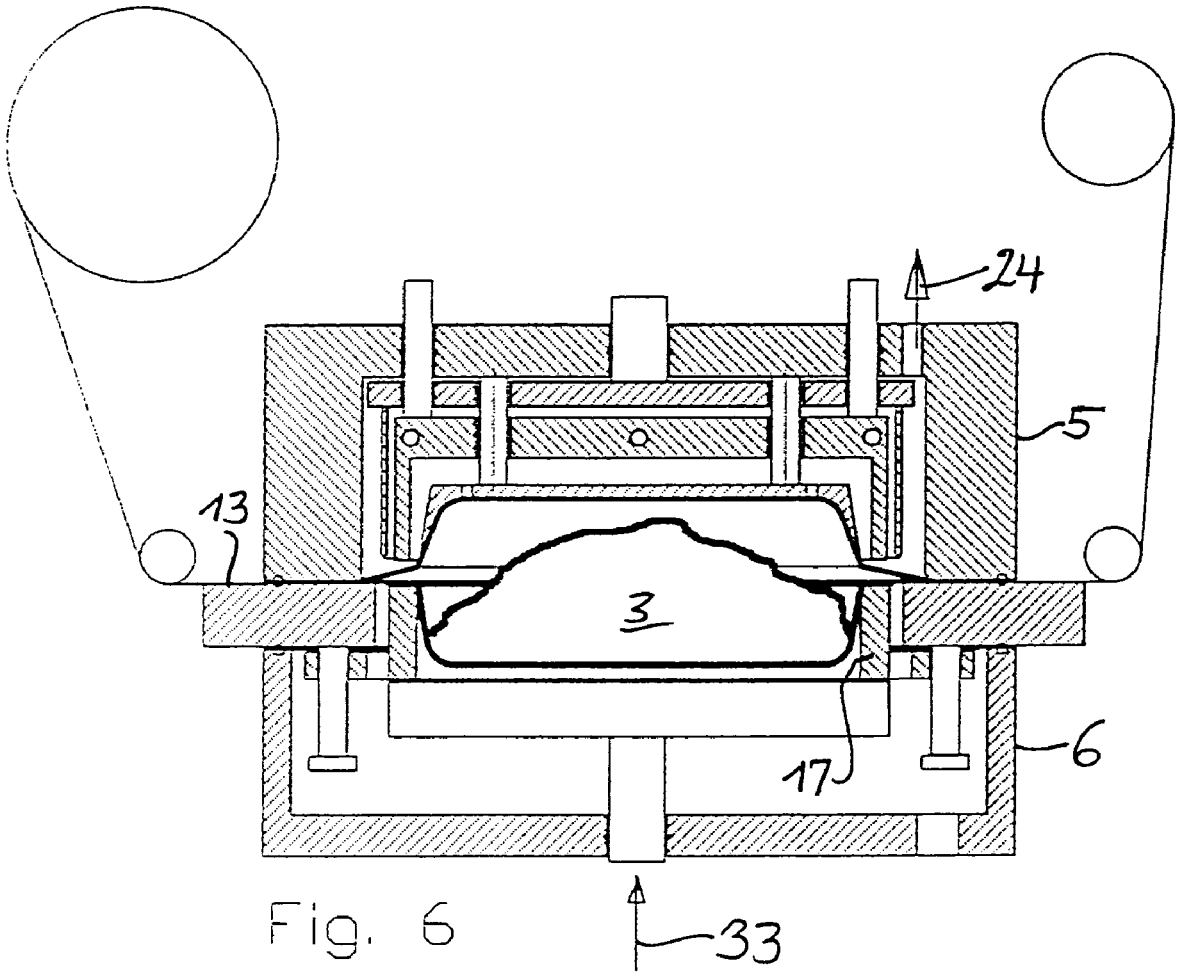
FIG. 6 the device shown in FIG. 5 with the tray raised.

In the step shown in FIGS. 4 and 5, in each case the tray 1 is held such low by the retracted position of the carrying part 17 that the product 3 still has a distance to the plane of the upper film 13. After the upper film is sucked to the internal surface of the forming device 9 in the step shown in FIG. 5, in the step shown in FIG. 6 the carrying part 17 is moved relative to the frame 15 in the direction to the upper tool 5 by a schematically indicated drive mechanism 33 such that its upper edge is located in the original plane of the upper film or is located in-plane with the surface of the frame 15 facing the upper tool, respectively. In this step, the evacuating device 24 remains turned on.

Figure 7A:
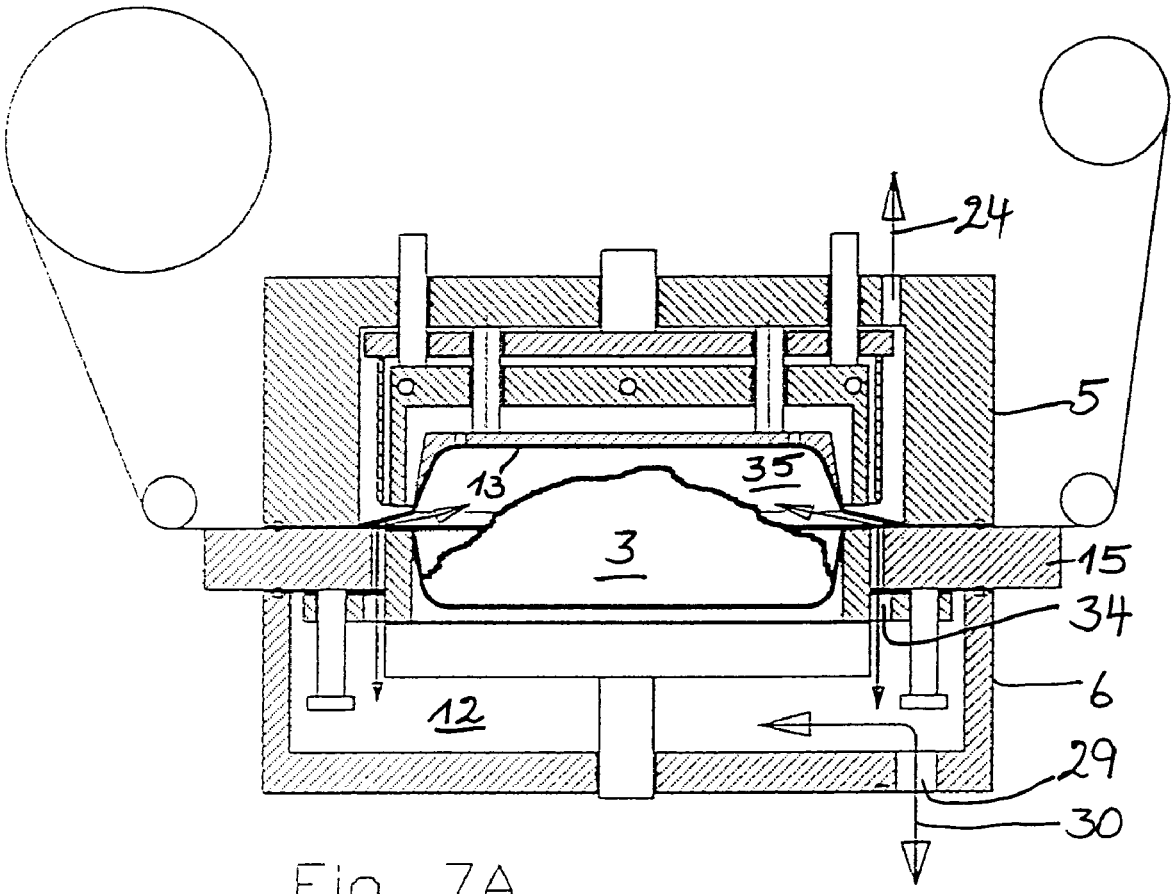
FIG. 7*a* the evacuating and sealing station shown in FIG. 6 in which the interior of the package is evacuated and possibly gas flushed.
Figure 7B:
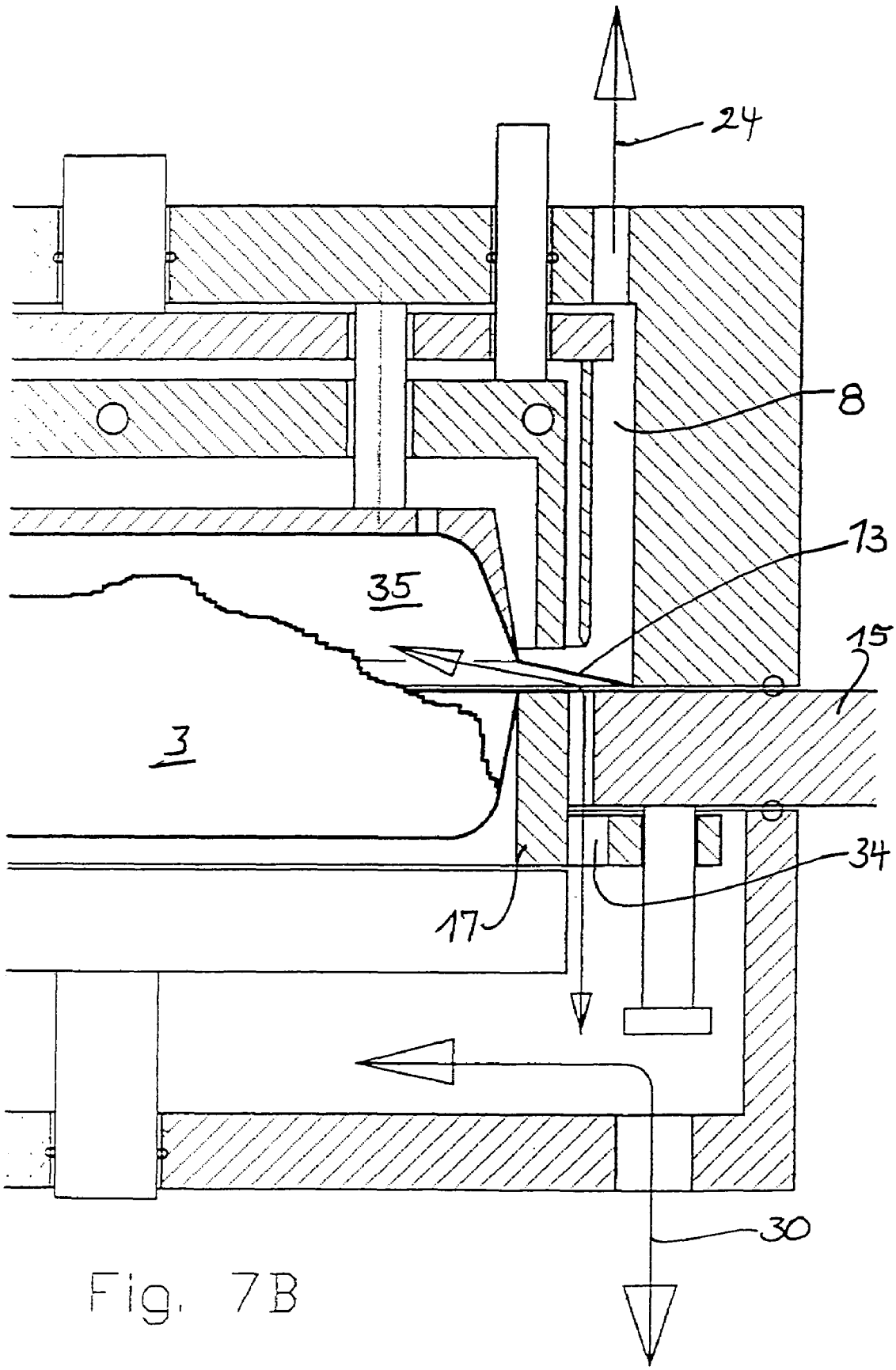
FIG. 7*b* an enlargement of a section of FIG. 7*a;*

In the step shown in FIG. 7A the evacuating and gas supplying device 30 is additionally switched on. In this way, at first evacuating takes place between the carrying part 17 and the frame 15 via a channel 34 extending circumferentially around the carrying part 17. This channel opens at a position which is separated from the internal space by the upper film 13 such that the space 35 between the product 3 and the stretched upper film 13 is evacuated. If it is desired, a supply of a protective gas into the space 35 is performed by a corresponding switching of the evacuating and gas supplying device 30.

In the next step shown in FIG. 8 the sealing tool 10 is moved into the sealing position by turning on of its pneumatic drive mechanism 26 and thereby the edge 2 of the tray 1 and the upper film are sealed hermetically and without creases. Subsequently, the pneumatic drive mechanism 27 for the cutting device 11 is turned on to move the cutting device into the separating position shown in FIG. 9 and thereby the completed package is separated from the upper film layer.

Figure 10:
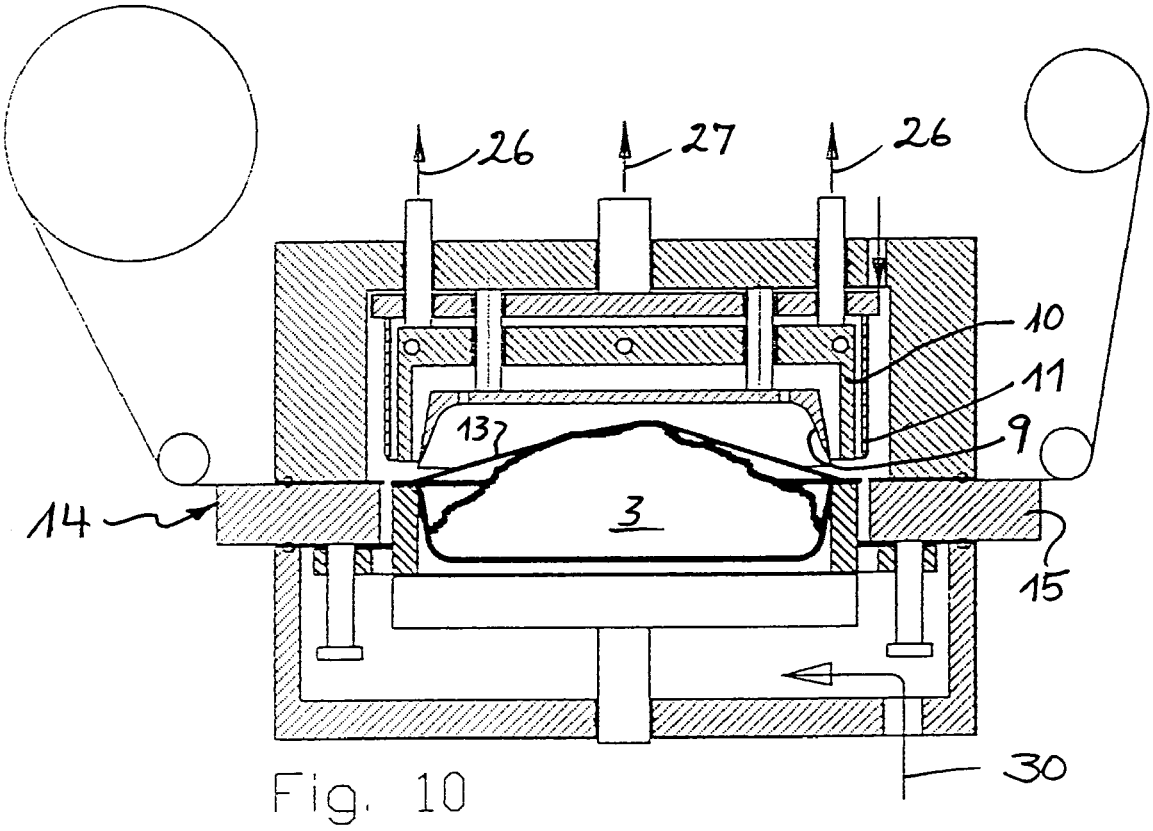
FIG. 10 the evacuating and sealing station with the interior of the chamber aerated.
Figure 11:
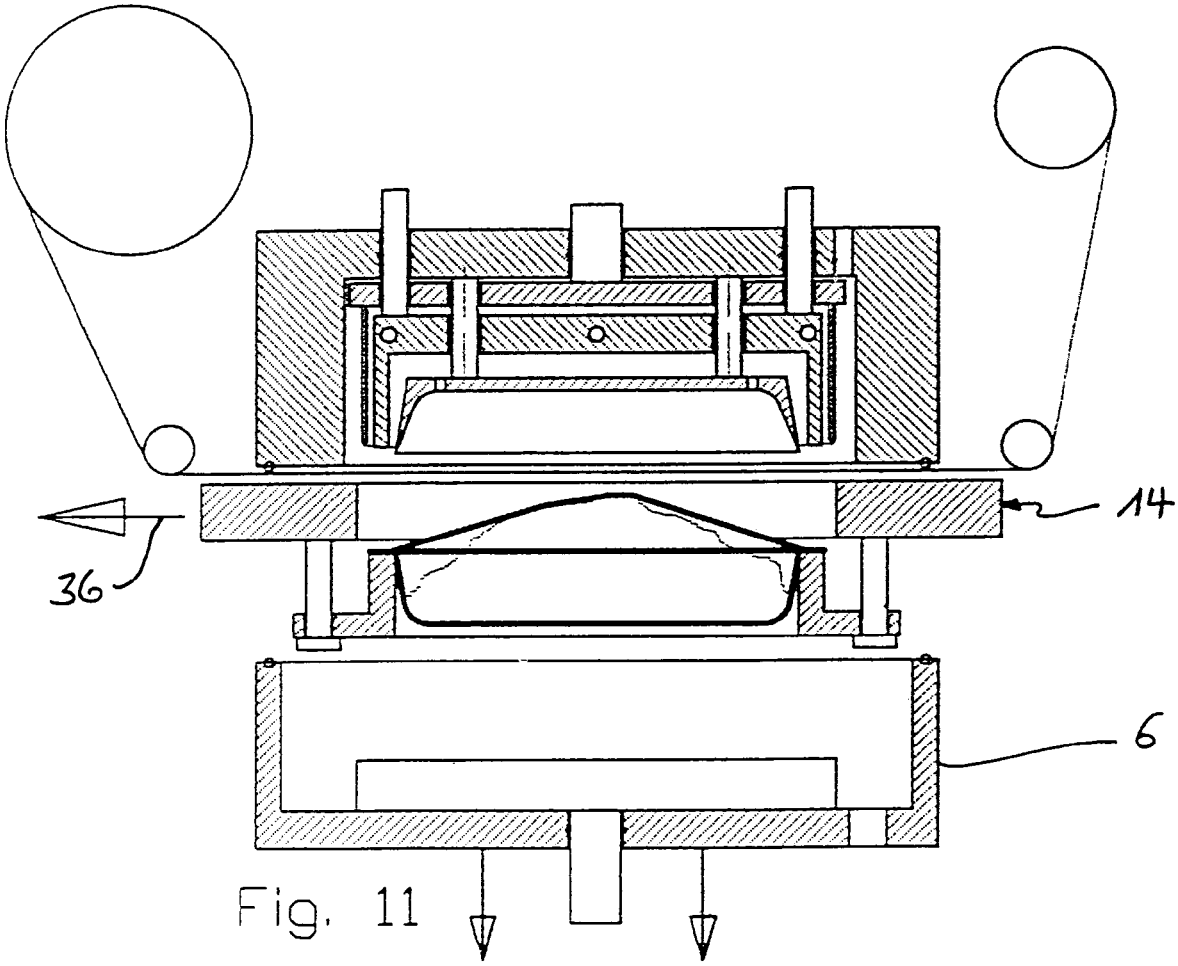
FIG. 11 the evacuating and sealing station opened for conveying out the tray carrier together with the completed package.

In the following step shown in FIG. 10 a retracting of the cutting device 11 and of the sealing tool 10 by switching the pneumatic drive mechanisms 26 and 27 as well as venting via the evacuating devices 24 and 30 is performed. By the venting via the evacuating device 24 the upper film 13 is detached from the concave surface of the forming device 9 and abates against the part of the product protruding the farthest. The lower tool 6 is moved into the retracted lower position by its drive mechanism and subsequently the tray carrier 14 is removed from the evacuating and sealing device in the direction of the arrow 36 such that the completed package can be taken off from the tray carrier.

In the embodiment described above, only one tray is introduced into the sealing station at a time. According to a modified embodiment the tray carrier is formed to accommodate a plurality of trays and to insert them into the sealing station for simultaneous sealing.

What is claimed is:

1. A method for packaging a product arranged in a tray located within a sealing chamber having an upper part and a lower part which are movable relative to each other wherein an upper film located in a distance above the product is clamped along an edge surrounding the tray and after the film is clamped, the film is stretched in a direction extending away from the product and pulled from the clamped edge, and wherein after the film is stretched, the tray is raised relative to the upper film, and then after the tray is raised, the edge of the tray and the upper film are sealed, wherein the clamping of the edge of the upper film is carried out by means of closing the chamber parts, and wherein the space surrounding the product is evacuated before sealing.

2. A method for packaging a product arranged in a tray according to claim 1, wherein the space surrounding the product is filled with a gas before sealing.

3. The method of claim 1 wherein the upper film is stretched in a direction extending upwardly away from the product.

* * * * *